US008115124B2

(12) United States Patent
Maruyama et al.

(10) Patent No.: US 8,115,124 B2
(45) Date of Patent: Feb. 14, 2012

(54) CIRCUIT BREAKER

(75) Inventors: Takanao Maruyama, Tokyo (JP); Kazuhiko Kagawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 301 days.

(21) Appl. No.: 12/608,506

(22) Filed: Oct. 29, 2009

(65) Prior Publication Data

US 2010/0307901 A1 Dec. 9, 2010

(30) Foreign Application Priority Data

Jun. 8, 2009 (JP) ..... 2009-137076

(51) Int. Cl.
*H01H 33/66* (2006.01)

(52) U.S. Cl. ..... 200/50.27; 218/118

(58) Field of Classification Search ..... 200/50.21, 200/50.27, 17 R, 293; 218/118, 119, 121, 218/134, 137, 139, 140, 152–155; 361/637, 361/652, 673, 676; 439/291
See application file for complete search history.

(56) References Cited

U.S. PATENT DOCUMENTS

| | | | | |
|---|---|---|---|---|
| 3,883,709 | A * | 5/1975 | Cole | 218/119 |
| 4,384,179 | A * | 5/1983 | Milianowicz | 200/50.27 |
| 5,436,414 | A * | 7/1995 | Hodkin et al. | 200/17 R |
| 5,486,662 | A * | 1/1996 | Takiishi | 200/50.27 |
| 5,530,216 | A * | 6/1996 | Benke et al. | 218/118 |
| 6,410,874 | B2 * | 6/2002 | Marin-Pache et al. | 218/118 |
| 6,410,875 | B2 * | 6/2002 | Allard et al. | 218/118 |
| 6,444,939 | B1 * | 9/2002 | Crookston et al. | 218/140 |
| 7,852,617 | B2 * | 12/2010 | Lee | 361/676 |

FOREIGN PATENT DOCUMENTS

| | | |
|---|---|---|
| JP | 6-208821 | 7/1994 |
| JP | 6-251646 | 9/1994 |
| JP | 8-222090 A | 8/1996 |

* cited by examiner

*Primary Examiner* — Michael Friedhoffer
(74) *Attorney, Agent, or Firm* — Buchanan Ingersoll & Rooney PC

(57) ABSTRACT

A flexible conductor which connects the movable rod side of a circuit breaker and a movable side connection conductor is devised to miniaturize the circuit breaker. In the circuit breaker in which a fixed electrode and a movable electrode are arranged to be capable of being connected/disconnected, and a terminal provided on the movable rod of the movable electrode and the movable side connection conductor arranged in the vicinity of the terminal are connected by a flexible conductor, the flexible conductor is formed by laminating a plurality of sheets of a belt-like metal sheet and has connection portions on both ends; one end side of the connection portion is connected to the terminal by keeping a width direction parallel to a drawing direction of the movable side connection conductor and by keeping a longitudinal direction parallel to a connecting/disconnecting direction; and in a state where an intermediate portion is twisted and bent in a right angle direction toward the movable side connection conductor to invert the front and back, the other end side of the connection portion is connected to the movable side connection conductor by keeping the width direction parallel to the connecting/disconnecting direction.

3 Claims, 4 Drawing Sheets

CIRCUIT BREAKER

BACKGROUND OF THE INVENTION

1. Field of the Invention

The present invention relates to, for example, a circuit breaker such as a vacuum circuit breaker using a vacuum valve and, in more detail, relates to a flexible conductor which connects the movable rod side and a connection conductor.

2. Description of the Related Art

A vacuum circuit breaker in which a known vacuum valve is used is shown in FIG. 6. The figure is a side view showing a state where the vacuum valve is closed. In the figure, a vacuum valve 20 is configured such that a fixed electrode 22 and a movable electrode 23 are contained inside a vacuum vessel 21 to be capable of being connected/disconnected. The fixed electrode 22 side is fixed by being connected to a fixed side connection conductor 26 which is fixed to a mounting plate 24 via an insulation supporting member 25. On the other hand, on the movable electrode 23 side, a movable rod 27 is led out; and one end side of a flexible conductor 29 is connected to a coupling 28 provided on the movable rod 27. The other end side of the flexible conductor 29 is connected to a movable side connection conductor 30 fixed to the mounting plate 24 via the insulation supporting member 25. Further, the end side of the movable rod 27 is coupled to a driving device (not shown in the figure) of an operating mechanism 33 via a lever 31 and an insulation rod 32. The configuration is made such that driving force of the driving device 33 is transmitted to the movable electrode 23 via the insulation rod 32 and the lever 31, the movable electrode 23 is vertically driven in the figure, and both electrodes 22 and 23 are connected/disconnected.

The flexible conductor 29 supplies current to the movable side connection conductor 30 from the movable rod 27 that moves vertically while mobility is maintained. Consequently, sufficient flexibility is required; and therefore, configuration is made so as to have flexibility by laminating thin copper bands. In the case of the figure, the belt-like flexible conductor 29 extending in a longitudinal direction is bent in an L shape; however, various embodiments are made in addition to this, for example, the flexible conductor 29 is bent in a U shape (for example, see Japanese Unexamined Patent Publication No. H8-222090 (pp. 3 to 4, FIG. 1)).

In the known vacuum circuit breaker as shown in Japanese Unexamined Patent Publication No. H8-222090, the belt-like flexible conductor extending in a longitudinal direction is bent in the L shape or is bent in the U shape, and is connected between the coupling and the movable side connection conductor. In order to satisfy necessary flexibility and durability as the flexible conductor, a certain length is required for a flexible portion all anyhow and it is difficult to directly bend the belt-like conductor in a direction orthogonal to the longitudinal direction; and therefore, there is a problem in that restriction is generated in arrangement of the coupling of the movable rod and the movable side connection conductor.

SUMMARY OF THE INVENTION

The present invention is made to solve the aforementioned problem, and an object of the present invention is to obtain a circuit breaker in which restriction of an arrangement relationship on the connection conductor side with respect to the movable rod side of the circuit breaker is reduced and miniaturization is achieved.

According to the present invention, there is provided a circuit breaker in which a fixed electrode coupled to a fixing rod and a movable electrode coupled to a movable rod are arranged to be capable of being connected/disconnected; and a terminal provided on the movable rod and a movable side connection conductor arranged in the vicinity of the terminal and drawn in a direction orthogonal to a connecting/disconnecting direction of the both electrodes are connected by a flexible conductor. The flexible conductor is formed by laminating a plurality of sheets of a belt-like metal sheet and has connection portions on both ends; one end side of the connection portion is connected to the terminal by keeping a width direction parallel to a drawing direction of the movable side connection conductor and by keeping a longitudinal direction parallel to the connecting/disconnecting direction; and in a state where an intermediate portion is twisted and bent in a right angle direction toward the movable side connection conductor to invert the front and back, the other end side of the connection portion is connected to the movable side connection conductor by keeping the width direction parallel to the connecting/disconnecting direction.

According to the circuit breaker of the present invention, the connection portion on one end side of the flexible conductor is connected to the terminal by keeping the width direction parallel to the drawing direction of the movable side connection conductor and by keeping the longitudinal direction parallel to the connecting/disconnecting direction; and in the state where the intermediate portion is twisted and bent in the right angle direction toward the movable side connection conductor to invert the front and back, the other end side of the connection portion is connected to the movable side connection conductor by keeping the width direction parallel to the connecting/disconnecting direction. Therefore, restriction in arrangement of the movable side connection conductor is reduced; and, in the case where the flexible conductor is used by locating in parallel, distance in the interphase direction can be reduced and the circuit breaker can be miniaturized.

Besides, one end side of the connection portion of the flexible conductor is connected to the terminal by keeping a width direction parallel to a drawing direction of the movable side connection conductor and by keeping a longitudinal direction parallel to the connecting/disconnecting direction; and in a state where an intermediate portion is twisted and bent in a right angle direction toward the movable side connection conductor, the other end side of the connection portion is connected to the movable side connection conductor by keeping a laminating direction parallel to the connecting/disconnecting direction.

Furthermore, in the mounting of the flexible conductor similar to the above mention, the other end side of the connection portion is connected to the movable side connection conductor by keeping the laminating direction parallel to the connecting/disconnecting direction; and therefore, a circuit breaker with a high degree of flexibility in mounting directions of the flexible conductor and the movable side connection conductor can be obtained.

The foregoing and other objects, features, aspects and advantages of the present invention will become more apparent from the following detailed description of the present invention when taken in conjunction with the accompanying drawings.

DETAILED DESCRIPTION OF THE INVENTION

Preferred Embodiment 1

Hereinafter, a circuit breaker according to a preferred embodiment 1 will be described on the basis of figures. In the present preferred embodiment, description will be made as an example in the case of a vacuum circuit breaker which uses a vacuum valve in a switching portion as a circuit breaker.

Figure 1:
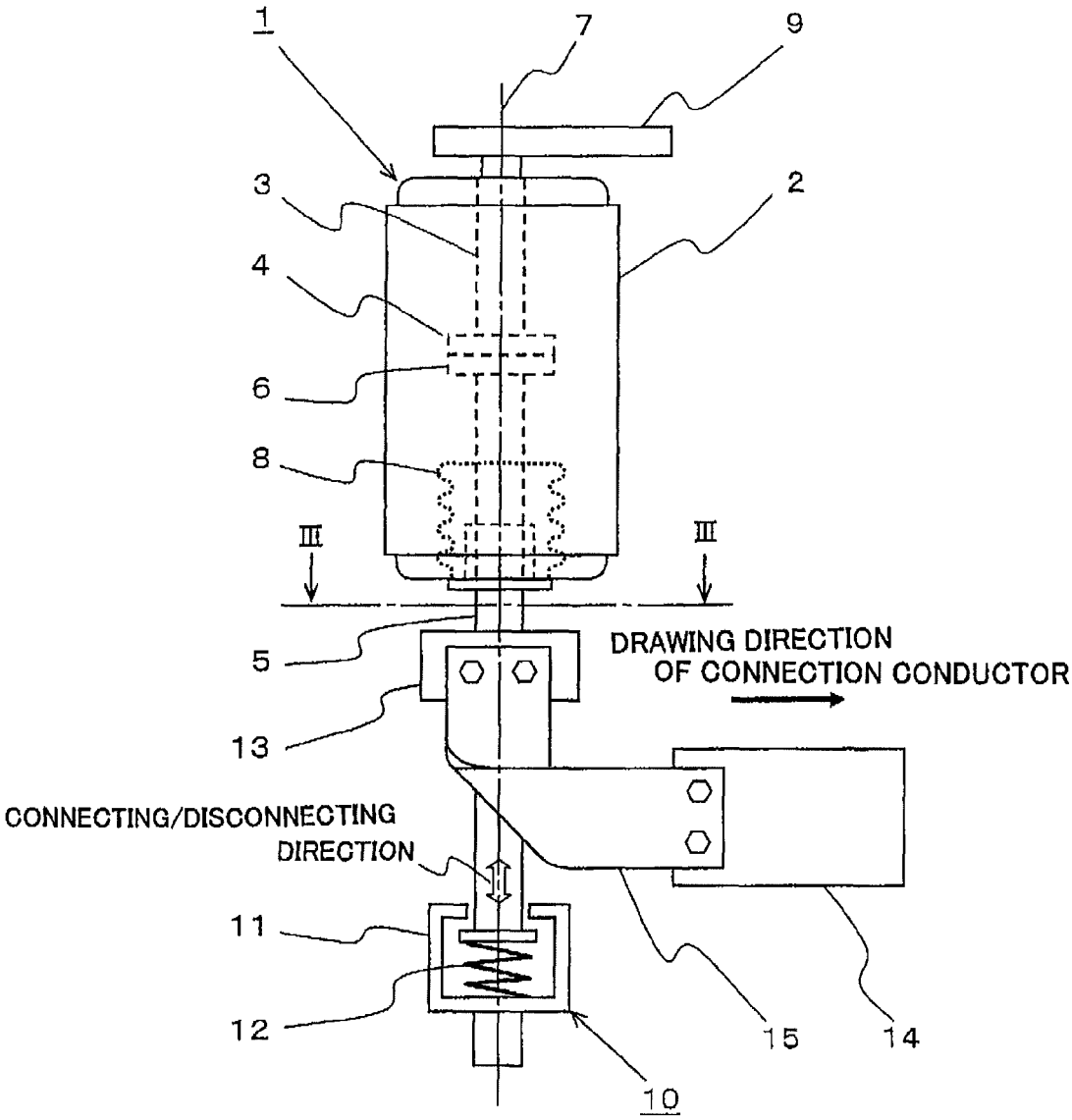
FIG. 1 is a side view of a major portion of a circuit breaker according to a preferred embodiment 1 of the present invention.

FIG. 1 is a side view of the vacuum circuit breaker according to the preferred embodiment 1, and only a major portion necessary for the description is shown. In the figure, the vacuum circuit breaker has three phase vacuum valves 1 which are arranged in three units in a direction perpendicular to the page space by being supported by an insulation supporting member (not shown in the figure); and the figure shows a state where only front one phase is seen. The vacuum valve 1 is configured such that a fixed electrode 4 coupled to a fixing rod 3 and a movable electrode 6 coupled to a movable rod 5 are arranged to be capable of being connected/disconnected on an axis line 7 serving as the center line of the vacuum valve 1 in an insulation vessel 2 whose inside is held under vacuum. The movable rod 5 is movable on the axis line 7 while maintaining airtight with the insulation vessel 2 via a bellows 8.

The fixing rod 3 is insulatively supported by an insulation supporting member not shown in the figure, and is connected to a fixed side connection conductor 9 drawn in a direction orthogonal to a connecting/disconnecting direction (direction of the axis line 7) of both electrodes 4 and 6.

On the other hand, the movable rod 5 is equipped with a contact pressure mechanism 10, which gives a proper contact pressure to a contact portion between both electrodes 4 and 6 when the movable electrode 6 is closed, at the end side. Further, an operating mechanism which drives the movable electrode 6 is coupled on the end side of the contact pressure mechanism 10; however, the operating mechanism is not a major portion of the present invention; and therefore, the operating mechanism is not shown in the figure.

The contact pressure mechanism 10 is configured by containing a contact pressure spring 12 in a case 11. In closing operation, driving force from the operating mechanism not shown in the figure is transmitted to the movable electrode 6 via the contact pressure mechanism 10 and the movable rod 5; the movable electrode 6 comes in contact with the fixed electrode 4 side; the contact pressure spring 12 is compressed when the driving force is further continuously applied; the movable electrode 6 is pressed by spring pressure thereof via the movable rod 5; and a predetermined contact pressure is exerted to the contact portion. In this regard, however, various shapes of the contact pressure mechanism 10 are known, and the figure shows one example.

In addition, at the middle of the movable rod 5, a split type terminal 13 is provided in a manner sandwiching the movable rod 5. Then, in the vicinity of the terminal 13, a movable side connection conductor 14 led out toward a direction orthogonal to the connecting/disconnecting direction is arranged by being supported by an insulation supporting member not shown in the figure.

A drawing direction of both connection conductors 9 and 14 is a direction shown by an arrow in the figure; and this is the opposite side to the side where the operating mechanism not shown in the figure is arranged, seen from the vacuum valve 1.

The terminal 13 and the movable side connection conductor 14 are connected by a flexible conductor 15. The invention as claimed in the application concerned has a feature in connection of the flexible conductor 15; and therefore, this portion will be further described in detail on the basis of the figure.

Figure 2:
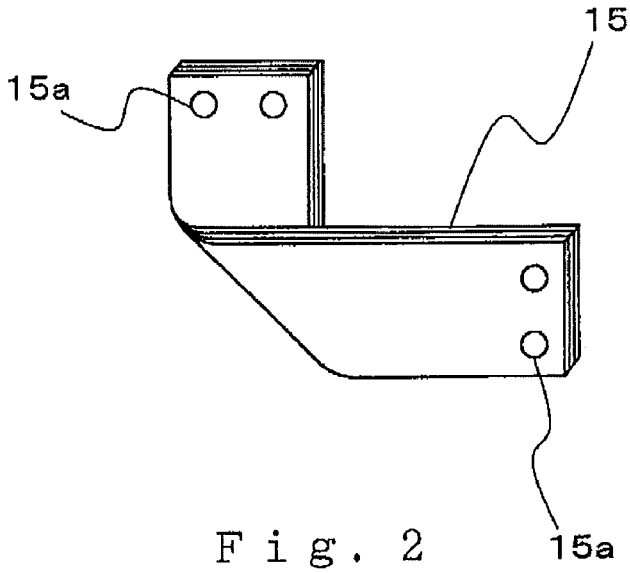
FIG. 2 is a perspective view of a flexible conductor for use in the circuit breaker shown in FIG. 1.
Figure 3:
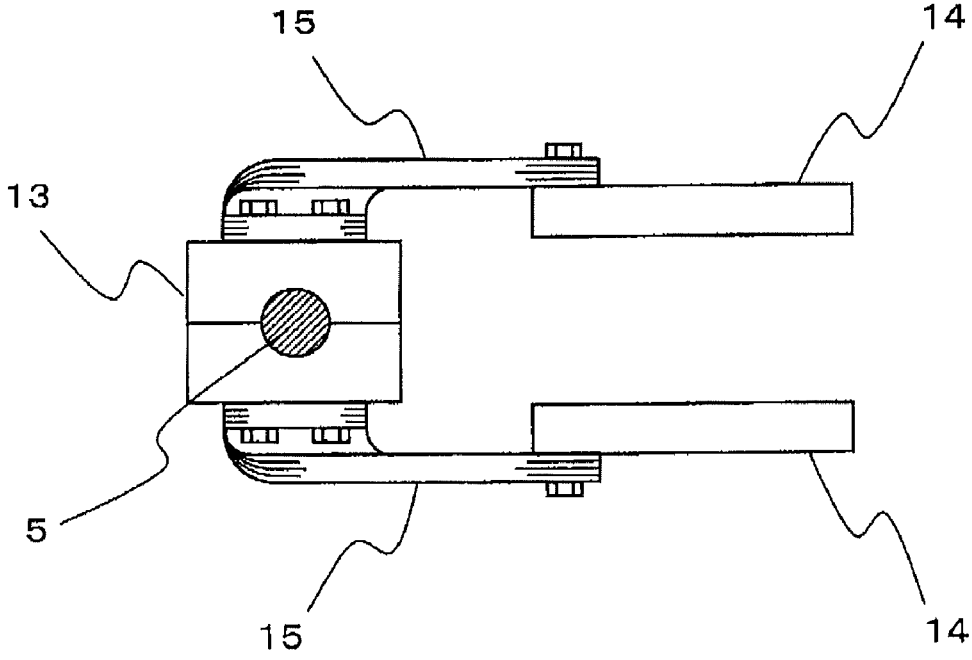
FIG. 3 is a plan view seen from the line III-III shown in FIG. 1.

FIG. 2 is a perspective view of the flexible conductor 15; and FIG. 3 is a plan view of a flexible conductor portion as seen from arrows III-III in FIG. 1.

First, description will be made starting from a shape of the flexible conductor 15 with reference to FIG. 2. The flexible conductor 15 is formed by laminating a plurality of sheets of a thin copper band, thereby having flexibility and conductivity. Both ends are each integrally formed by brazing, soldering, or the like; and bolt holes 15*a* for mounting are formed to provide connection portions.

Since a current not less than 1000 A is flown through the flexible conductor 15 depending on a capacity of a circuit breaker; for example, 50 to 100 sheets each having a thin copper band of approximately 0.05 mm in thickness and 50 to 100 mm in width are formed. Therefore, ordinarily, bending in a lamination direction can be performed easily; however, directly bending in a width direction is very difficult.

Consequently, as shown in FIG. 1, as for the flexible conductor 15 of the present preferred embodiment, one end side of the connection portion is connected to the terminal 13 by bolting by keeping the width direction parallel to the drawing direction of the movable side connection conductor 14 and by keeping the longitudinal direction parallel to the connecting/disconnecting direction; and in a state where an intermediate portion of the longitudinal direction is twisted and bent in a right angle direction toward the movable side connection conductor 14 to invert the front and back, the other end side of the connection portion is connected to the movable side connection conductor 14 by bolting by keeping the width direction parallel to the connecting/disconnecting direction.

The twist and the bend do not need to be compositionally-deformed by being forcibly bent by a pressing jig or the like; but, the twist and the bend may be made by a curvature approximately capable of being bent by hand and formed to be a state as shown in FIG. 2; and then, the ends may be aligned and fixed by soldering or the like. The twist portion is made to have flexibility for a movable stroke of the movable rod 5.

As shown in the plan view of FIG. 3, two flexible conductors, which are composed of the flexible conductor 15 formed as shown in FIG. 2 and one manufactured in a right and left symmetrical manner with respect to the flexible conductor 15, are prepared while sandwiching the movable rod 5 from both sides in the interphase direction of the vacuum valve 1, and are connected in parallel to the terminals 13 and the movable side connection conductors 14.

As described above, mounting faces between the flexible conductor 15 and the movable side connection conductor 14 can be in parallel to the connecting/disconnecting direction by the combination of the twist and the bend of the flexible conductor 15; and therefore, restriction in arrangement direction of the movable side connection conductor 14 with respect to the movable rod 5 is reduced as compared with the case of being bent only in a thickness direction as in the known way.

More particularly, as shown in FIG. 3, in the case where two flexible conductors 15 are used in parallel for large current, the flexible conductor 15 can be prevented from projecting toward the interphase direction of the vacuum valve 1 and a face of the movable side connection conductor 14 can be arranged so as to be in parallel to the connecting/disconnecting direction; and therefore, an interphase distance can be reduced and thus the circuit breaker can be miniaturized.

Incidentally, in the case where a capacity of the circuit breaker is small and a current value is small, two flexible conductors 15 do not need to be provided in parallel; but, one flexible conductor may be provided on only one side.

As described above, according to the circuit breaker of the preferred embodiment 1, one end side of the connection portion of the flexible conductor is connected to the terminal by keeping the width direction parallel to the drawing direction of the movable side connection conductor and by keeping the longitudinal direction parallel to the connecting/disconnecting direction; and in a state where an intermediate portion is twisted and bent in a right angle direction toward the movable side connection conductor to invert the front and back, the other end side of the connection portion is connected to the movable side connection conductor by keeping the width direction parallel to the connecting/disconnecting direction. Therefore, a connection face between the flexible conductor and the movable side connection conductor can be adjusted to the connecting/disconnecting direction of both electrodes, and a width face of the movable side connection conductor can be arranged toward the connecting/disconnecting direction; and thus, the circuit breaker in which restriction in arrangement direction is reduced can be obtained.

In addition, the flexible conductor includes two flexible conductors formed in a symmetrical manner, and the two flexible conductors are arranged while sandwiching the movable rod and are connected in parallel to the terminals and the movable side connection conductors; and therefore, projection in the interphase direction of three phase circuit breaker can be reduced in size and thus the circuit breaker can be miniaturized.

Preferred Embodiment 2

Figure 4:
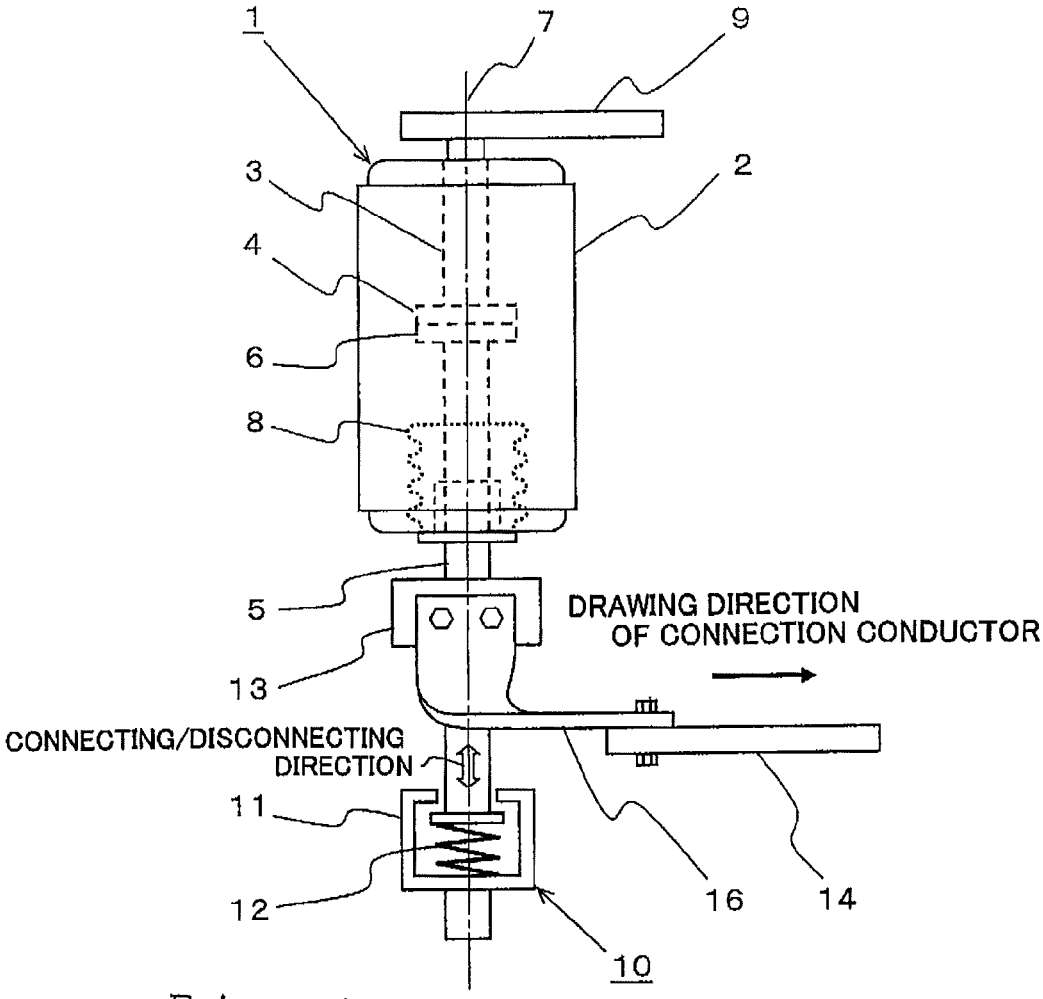
FIG. 4 is a side view of a major portion of a circuit breaker according to a preferred embodiment 2 of the present invention.

FIG. 4 is a side view showing a relevant portion of a circuit breaker according to a preferred embodiment 2. Constituent elements equivalent to those of FIG. 1 of the preferred embodiment 1 are shown by the same reference numerals and their description will not be repeated, but will be described covering mainly a different point. The different point is a mounting direction of a flexible conductor.

A flexible conductor 16 of the present preferred embodiment is the same as the case shown in FIG. 2 in that a plurality of sheets of a thin copper band are laminated and connection portions are provided on both ends.

One end side of the connection portion is connected to a terminal 13 by keeping a width direction parallel to a drawing direction of a movable side connection conductor 14 and by keeping a longitudinal direction parallel to a connecting/disconnecting direction; and in a state where an intermediate portion of the longitudinal direction is twisted and bent in a right angle direction toward the movable side connection conductor 14, the other end side of the connection portion is connected to the movable side connection conductor 14 by keeping a lamination direction parallel to the connecting/disconnecting direction.

Figure 5:
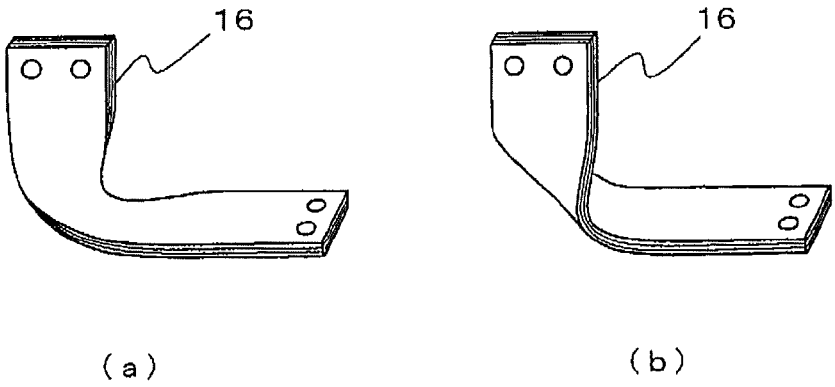
FIGS. 5A and 5B are each a perspective view of a flexible conductor for use in the circuit breaker shown in FIG. 4.
Figure 6:
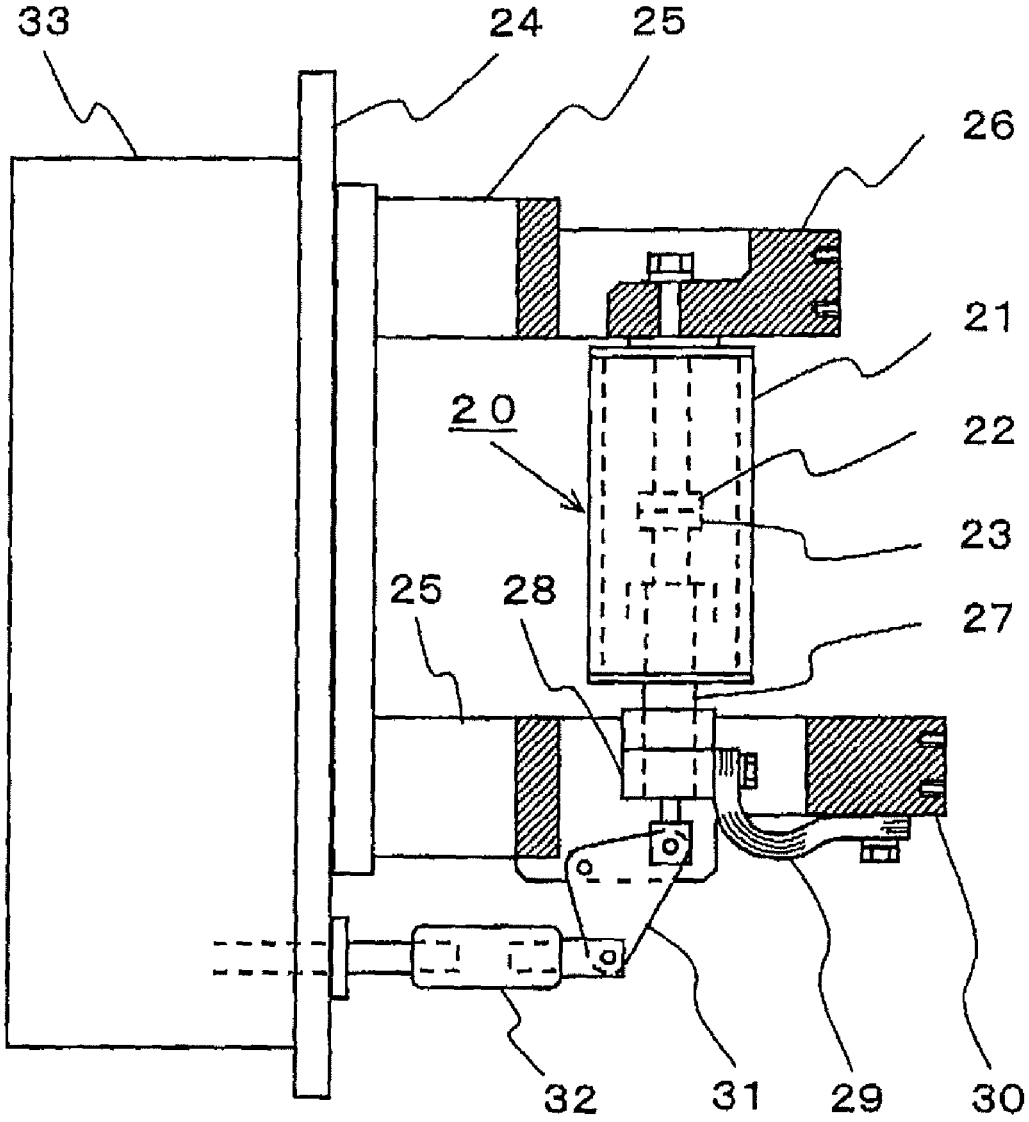
Fig. 6 (PRIOR ART)
FIG. 6 is a side view of a known circuit breaker.

FIGS. 5A and 5B show perspective views of the flexible conductor 16. If in the case of FIG. 5A, for example, the lower side is bent to the front side by 90 degrees to form in an L shape from a state where a width face is faced toward a front face and the longitudinal direction is faced toward a vertical direction; and then, the front side may be twisted to the right in a horizontal direction. Formation may also be made as shown in FIG. 5B by reversing the twisting direction. In each case, formation may finally be made as shown in the figures; and therefore, a processing sequence of a formation process and a processing method are no object.

As described above, according to the circuit breaker of the preferred embodiment 2, the flexible conductor is formed by laminating a plurality of sheets of a belt-like metal sheet and has connection portions on both ends; one end side of the connection portion is connected to the terminal by keeping the width direction parallel to the drawing direction of the movable side connection conductor and by keeping the longitudinal direction parallel to the connecting/disconnecting direction; and in a state where the intermediate portion is twisted and bent in a right angle direction toward the movable side connection conductor, the other end side of the connection portion is connected to the movable side connection conductor by keeping the laminating direction parallel to the connecting/disconnecting direction. Therefore, restriction in direction of the mounting faces between the flexible conductor and the movable side connection conductor is reduced; and the circuit breaker with a high degree of flexibility in mounting can be obtained.

Incidentally, in the preferred embodiments 1 and 2, the description is made by regarding the circuit breaker as the vacuum circuit breaker; however, the present invention is not limited to this, but can be applied to a general circuit breaker which interrupts large current.

In addition, the description is made by regarding the thin copper band as the material of the flexible conductor; however, an aluminum plate may be used.

While the presently preferred embodiments of the present invention have been shown and described. It is to be understood that these disclosures are for the purpose of illustration and that various changes and modifications may be made without departing from the scope of the invention as set forth in the appended claims.

What is claimed is:

1. A circuit breaker in which a fixed electrode coupled to a fixing rod and a movable electrode coupled to a movable rod are arranged to be capable of being connected/disconnected; and a terminal provided on the movable rod and a movable side connection conductor arranged in the vicinity of the terminal and drawn in a direction orthogonal to a connecting/disconnecting direction of the both electrodes are connected by a flexible conductor, wherein the flexible conductor is formed by laminating a plurality of sheets of a belt-like metal sheet and has connection portions on both ends; one end side of the connection portion is connected to the terminal by keeping a width direction parallel to a drawing direction of the movable side connection conductor and by keeping a longitudinal direction parallel to the connecting/disconnecting direction; and in a state where an intermediate portion is twisted and bent in a right angle direction toward the movable side connection conductor to invert the front and back, the other end side of the connection portion is connected to the movable side connection conductor by keeping the width direction parallel to the connecting/disconnecting direction.

2. The circuit breaker according to claim 1, wherein the flexible conductor includes two flexible conductors formed in a symmetrical manner, the two flexible conductors being arranged while sandwiching the movable rod and being connected in parallel to the terminals and the movable side connection conductors.

3. A circuit breaker in which a fixed electrode coupled to a fixing rod and a movable electrode coupled to a movable rod are arranged to be capable of being connected/disconnected; and a terminal provided on the movable rod and a movable side connection conductor arranged in the vicinity of the terminal and drawn in a direction orthogonal to a connecting/disconnecting direction of the both electrodes are connected by a flexible conductor, wherein the flexible conductor is formed by laminating a plurality of sheets of a belt-like metal sheet and has connection portions on both ends; one end side of the connection portion is connected to the terminal by keeping a width direction parallel to a drawing direction of the movable side connection conductor and by keeping a longitudinal direction parallel to the connecting/disconnecting direction; and in a state where an intermediate portion is twisted and bent in a right angle direction toward the movable side connection conductor, the other end side of the connection portion is connected to the movable side connection conductor by keeping a laminating direction parallel to the connecting/disconnecting direction.

* * * * *